US010236148B2

(12) United States Patent
Lell

(10) Patent No.: US 10,236,148 B2
(45) Date of Patent: Mar. 19, 2019

(54) ELECTRIC SWITCH, IN PARTICULAR FOR HIGH VOLTAGES AND/OR HIGH CURRENTS

(71) Applicant: Peter Lell, Moosburg (DE)

(72) Inventor: Peter Lell, Moosburg (DE)

( * ) Notice: Subject to any disclaimer, the term of this patent is extended or adjusted under 35 U.S.C. 154(b) by 66 days.

(21) Appl. No.: 15/329,397

(22) PCT Filed: Jul. 30, 2015

(86) PCT No.: PCT/DE2015/100320
§ 371 (c)(1),
(2) Date: Jan. 26, 2017

(87) PCT Pub. No.: WO2016/015719
PCT Pub. Date: Feb. 4, 2016

(65) Prior Publication Data

US 2017/0229267 A1 Aug. 10, 2017

(30) Foreign Application Priority Data

Jul. 30, 2014 (DE) ..... 10 2014 110 825

(51) Int. Cl.
*H01H 39/00* (2006.01)
*H01H 3/22* (2006.01)
*H01H 3/28* (2006.01)

(52) U.S. Cl.
CPC ..... *H01H 39/00* (2013.01); *H01H 3/222* (2013.01); *H01H 3/28* (2013.01)

(58) Field of Classification Search
CPC ..... H01H 39/00; H01H 3/222; H01H 39/004; H01H 39/006; H01H 1/365; H01H 1/20; H01H 1/42; H01H 1/385; H01H 1/40
USPC ..... 200/48 R, 61.08, 16 A, 243, 254; 337/401, 404, 406
See application file for complete search history.

(56) References Cited

U.S. PATENT DOCUMENTS

| | | | | |
|---|---|---|---|---|
| 3,118,986 | A | 1/1964 | Lewis et al. | |
| 4,530,949 | A | 7/1985 | Atkinson et al. | |
| 5,783,987 | A | 7/1998 | Kern et al. | |
| 6,344,788 | B1 | 2/2002 | Forys et al. | |
| 9,418,807 | B2 * | 8/2016 | Marlin | H01H 1/365 |
| 9,646,788 | B2 * | 5/2017 | Parks | H01H 39/004 |
| 2005/0157480 | A1 | 7/2005 | Sun et al. | |
| 2013/0126326 | A1 | 5/2013 | Borg | |
| 2015/0206681 | A1 | 7/2015 | Marlin et al. | |

(Continued)

FOREIGN PATENT DOCUMENTS

| | | | |
|---|---|---|---|
| CA | 2877890 | A1 | 1/2014 |
| DE | 2623816 | A1 | 12/1977 |
| DE | 19712387 | A1 | 10/1997 |

(Continued)

*Primary Examiner* — Edwin A. Leon
*Assistant Examiner* — Lheiren Mae A Caroc
(74) *Attorney, Agent, or Firm* — The Webb Law Firm

(57) ABSTRACT

An electrical switch, in particular for high voltages and/or high currents, includes a contact unit which includes at least two contact, a switching element and a drive for the switching element. The drive is designed such that it can move the switching element from an initial position into an end position. The switching element is accelerated during an acceleration phase directly or indirectly by the drive and it passes subsequently through a free movement phase until it has reached the end position.

20 Claims, 13 Drawing Sheets

(56) References Cited

U.S. PATENT DOCUMENTS

2015/0248979 A1 9/2015 Parks et al.

FOREIGN PATENT DOCUMENTS

| | | | |
|---|---|---|---|
| DE | 19819662 | A1 | 11/1998 |
| DE | 10254497 | B3 | 6/2004 |
| DE | 69930233 | T2 | 12/2006 |
| DE | 102010010669 | A1 | 9/2011 |
| EP | 0450104 | A1 | 10/1991 |
| EP | 0690466 | A1 | 1/1996 |
| EP | 2701476 | A1 | 2/2014 |
| FR | 2953322 | A1 | 6/2011 |
| WO | 2009041064 | A1 | 4/2009 |
| WO | 2013185815 | A1 | 12/2013 |
| WO | 2014048495 | A1 | 4/2014 |

* cited by examiner

Schnitt B - B

Schnitt C - C

ELECTRIC SWITCH, IN PARTICULAR FOR HIGH VOLTAGES AND/OR HIGH CURRENTS

CROSS-REFERENCE TO RELATED APPLICATIONS

This application is the United States national phase of International Application No. PCT/DE2015/100320 filed Jul. 30, 2015, and claims priority to German Patent Application No. 10 2014 110 825.6 filed Jul. 30, 2014, the disclosures of which are hereby incorporated in their entirety by reference.

BACKGROUND OF THE INVENTION

Field of the Invention

The invention relates to an electric switch, in particular for high voltages and/or high currents.

For switching high voltages and optionally also high currents (amperages), use is made of electric switches in which a switching member is moved from an initial position linearly into an end position in order to trigger the desired switching process; for example, in order to connect two terminal contacts of a contact unit in the end position of the switching member that are electrically insulated from each other in the starting position of the switching member.

Description of Related Art

For example, DE 10 2010 010 669 A1 discloses a switch for bridging submodules of an inverter, in which a vacuum switching tube is dispensed with. This is achieved by the switching member of the switch being pyrotechnically driven, thereby reaching sufficiently high movement velocities for the switch such that longer switching paths, which become necessary as a result of dispensing with the array of contacts in a high vacuum, also become possible in order to maintain the required insulation distances. In this case the pyrotechnic drive unit comprises electrically conductive outer walls, inside of which a telescoping slide element is arranged. When a pyrotechnic propellant charge is ignited, the slide element is subjected, on its back side, to the gas pressure generated by the propellant charge, and moved to a stationary contact while the gas pressure is maintained. The previously interrupted contact between the electrically conductive outer wall of the drive and the stationary contact is thus closed, wherein the electrical connection runs via the outer wall of the drive, the slide element that is thus likewise electrically connected in the end position, and the stationary contact.

The disadvantage herein lies in the fact that with such a construction of the pyrotechnic drive, only a relatively limited switching path is possible, and hence only a limited insulation distance is available in the initial position. In addition, only a two-pole switch with a closing function is possible with the telescopic arrangement of the slide element inside the stationary walls of the drive.

SUMMARY OF THE INVENTION

On the basis of this prior art, the object of the invention is that of producing an electric switch, in particular for high voltages and/or high currents (amperages), that has greater switching paths and that can be configured in a variable manner in terms of the number of contacts and the nature of the switching processes (opening or closing switching processes).

The invention is based on the finding that the switching member can be accelerated indirectly or directly by the drive during an acceleration phase, and that it then passes through a free movement phase until it reaches the end position. This gives rise to greater degrees of freedom in the design of the switch; in particular larger switching paths and insulation distances are possible.

The switching member and the contacts, if suitably designed, also enable the practically simultaneous opening and/or closing of a plurality of contacts.

In one variant, after reaching a certain momentum or certain kinetic energy, the actual switching member can be uncoupled from the drive and then pass through a free movement phase in which the switching member is no longer subjected to drive forces. Hence in this variant, the switching member is only coupled to the drive until the free movement phase is reached. Thus, considerably greater movement paths for the switching member and greater insulations distances are possible than with switches in which the switching member always stays coupled to the drive, in other words ones in which the switching member is subjected to the drive forces during practically the entire switching path between the initial position and the end position. In this variant of the invention, however, the drive itself must always be positioned close enough to the switching member or to the contact unit such that a coupling to the switching member during the acceleration phase is possible.

In another variant, the drive forces are not transferred directly to the switching member during the acceleration phase, but indirectly via a momentum transfer element. In this process, the momentum transfer element coupled directly to the drive is first accelerated to a prespecified kinetic energy or to a prespecified momentum and then uncoupled from the drive. The momentum transfer element can then pass through a free movement phase before it impacts the switching member in projectile fashion and transfers at least a substantial portion of its momentum to the switching member. The switching member is thus accelerated to a specific kinetic energy or to a specific momentum, which is chosen such that a sufficient switching velocity is achieved. Hence in this variant, the actual drive is always uncoupled from the switching member and only accelerates the momentum transfer element. The drive can therefore also be positioned further away from the switching member. This makes it possible, for example, to produce switches in which the contact unit is at a high potential and only a partial voltage of a total voltage can be carried between the contacts. In this case the drive as well does not have to be arranged at the high potential, but can be at a lower or even zero potential. In these embodiments, the switching member is accelerated by means of momentum transfer to a desired kinetic energy or to a desired momentum that suffices for achieving the required switching time.

The drive can preferably be configured as a pyrotechnic drive, in which a gas-generating material is activated in a controllable fashion. To this end, use can also be made of materials (such as tetrazene, for example) which simply vaporize when activated; in principle, explosive materials are also possible if particularly fast processes are desired or required. Here it should be mentioned that in pyrotechnics worldwide, by definition an explosive effect is one in which flame front velocities greater than 2000 m/sec are reached. However, mainly due to safety reasons the use of an explosive material in the production or manipulation of the drive is only considered in exceptional cases. The very short switching times required are also achievable with non-explosive (i.e., deflagrating) materials. The switching times that are typically possible herewith range from 0.5 to 2 ms (from 2 ms to 20 ms for switches with very large dimensions), wherein the velocity of the switching member or the degree of momentum transfer ranges from 20 m/sec to 1000 m/sec.

The drive can also be produced in any other suitable manner, in particular also as an electrodynamic drive in which a "magnetic field pulse" is generated by means of a coil to which a brief surge is applied, which magnetic field pulse then generates eddy currents in a metal, non-magnetic drive elements, which eddy currents in turn generate a magnetic field directed against the driving magnetic field impulse, which leads to a repulsion of the drive element. In this manner, it is also possible to generate appropriately high drive forces that accelerate the drive element in such a way that a desired kinetic energy or a desired kinetic momentum is reached.

The drive can be configured as a unit, regardless of the acceleration mechanism, e.g., acceleration via electrodynamically or pyrotechnically generated forces. In this case the drive has a drive element that transfers the accelerating forces indirectly or directly to the switching member. In this case the drive is configured such that the drive element still remains in the drive even after the drive is triggered. The drive element preferably also does not project out of the drive housing during or after the triggering of the drive. This gives rise to additional safety while assembling, installing, or working with the drive unit, particularly in terms of an accidental triggering.

However, it is also possible to use the switching member itself (for a direct acceleration of the switching member by the drive) or the momentum transfer element itself (for an indirect acceleration of the switching member by the drive) as a drive element that will be subjected to the drive forces.

According to one design of the invention, a moving drive element of the drive is connected to the switching member in such a way that, during a stop phase following an acceleration phase of the moving element, the switching member separates from the drive element and then passes through the free movement phase. To this end, the switching member can be connected to the drive element by means of, for example, a press fit. It is also possible to configure the drive element and the switching member as a single piece and to provide a predetermined breaking point between the drive element and the switching member, which is designed to break as a consequence of the deceleration during the stop phase and enable the switching member to transition into its free movement phase.

As already described above, the drive can also have, optionally in addition to a drive element, a momentum transfer element that, when a switching process is triggered by an activation of the drive, accelerates toward the switching member and is then uncoupled from the drive such that the momentum transfer element passes through a free flight phase with a prespecified momentum and transfers at least a portion of the momentum to the switching member such that the switching member is moved from the initial position into the end position. In this case as well use can be made of an appropriate mechanical coupling, for example by means of a press fit, of the momentum transfer element to a drive element. The momentum transfer element and the drive element can also be configured as a single piece with a predetermined breaking point between both parts.

In one design of the invention, the momentum transfer element and the switching member can be of such kind that the momentum transfer element connects to, in particular fuses to the switching member upon impacting the same and is moved together with the switching member from the initial position into the end position.

At least then, if the switching member is held in its initial position without substantial retention forces or by ones that are negligible in comparison to the acceleration forces generated by the impact of the momentum transfer element, the momentum arising for the entire switching member-momentum transfer element unit after the acceleration phase can be calculated according to the relationship for the completely inelastic impact.

According to one design of the invention, the switching member, when viewed in its movement direction, can consist of at least one contact part made of an electrically conductive material and at least one insulator part made of an electrically insulating material, for example, of a front contact part and a rear insulator part when viewed in the movement direction. It is thus possible to carry out a plurality of switching processes simultaneously with a single switching member, wherein the necessary insulating distances can be maintained.

The contact unit and the switching member can be configured such that the switching member, in the end position, is held with the at least one insulator part in a contact of the contact unit in such a way that there is a minimum required insulating distance between the contact part and the contact. The at least one insulator part can also form the back end (viewed in the movement direction) of the switching member. In this case the insulator part is used to hold or fix the switching member, also in the back area thereof, securely in the contact unit.

In one design, the switching member can have a stop area, which is preferably provided on the front end (viewed in the movement direction) of the switching member and configured such that the switching member is braked at the end of the free movement phase until it reaches the end position, wherein to this end the stop area interacts with a separate stationary braking element of the contact unit, or with a braking contact of the contact unit configured as a braking element.

The stop area can interact with an aperture provided in the braking element or in the braking contact, which aperture is provided coaxially in the braking element or braking contact with respect to the movement direction and the longitudinal axis of the switching member, wherein the stop area engages in the aperture, at least during a stop phase, until the end position is reached.

For this purpose, the stop area can have a radial stop flange or one or a plurality of radially outward extending contact projections, which interact with a wall surrounding the aperture in the braking element or in the braking contact for limiting the axial movement of the switching member in the free movement phase. However, this gives rise to an abrupt stopping process with a corresponding impact on the braking element, which can obviously also be transmitted to the rest of the contact unit if the contact unit is arranged, for example, on a common base in order to maintain the distances of the contacts.

In another embodiment, the stop area can have an area that tapers conically toward the front end of the switching member, which area interacts with the inner wall of the aperture in the braking element or in the braking contact for braking the axial movement of the switching member in the free movement phase, wherein the inner wall of the aperture, with respect to the longitudinal axis and the movement direction of the switching member, is configured as tapering conically, wherein the cone angle of the inner wall of the aperture is preferably configured as equal to or greater, i.e., more strongly tapering, than the cone angle of the tapering area of the switching member. This results in less strong deceleration during the braking of the switching member than in the case of a stop.

The stop area can have in its periphery and/or the aperture can have in its inner wall a structuring that is configured such that a material flow results when the stop area engages in the aperture during the switching movement of the switching member, which preferably leads to the fusion of the stop area with the contact.

The stop area can have in particular axially running grooves or axially running and radially outward extending projections, the axially running outer surfaces of which are each located on an imaginary cone that tapers toward the front end of the switching member. In another embodiment or in addition, the inner wall of the aperture can have axially running grooves or axially running and radially inward extending projections, the axially running inner surfaces of which are each located on an imaginary cone that tapers in the movement direction of the switching member, wherein the geometry of the stop area and of the aperture and the material, at least of the projections, are of a kind such that there is a material flow during the braking of the switching member.

In another variant, in the stop area provision can be made of an axially displaceable, preferably slotted ring, which is configured and which interacts with the aperture in the braking element or braking contact such that with progressing axial movement of the switching member or of the contact part during the stop phase, the radial contact pressure between the inner wall of the aperture and the outer wall of the switching member or contact part in the stop area increases, thereby generating an axial braking effect until the end position is reached.

In terms of geometry and materials, the stop area and the aperture can be configured and adjusted to the kinetic energy of the switching member to be braked such that during the braking of the switching member, at least a partial area of the stop area fuses with the braking element or the braking contact. This gives rise to a more permanent and more secure mechanical and electrical contact between the switching member and the braking element or the contact acting as a braking element.

Regardless of other features relating to the drive or to the rest of the switching member (and in terms of the functionality thereof), such structures in the stop area and/or in the aperture of a braking contact can also be used to produce a switch that effects the secure closing of an electrical contact. The combination of such a braking contact with another contact, with a multi-contact (see below) for the switching member inserted in the aperture thereof, gives rise to a switch that ensures a superior and durable electrical contact. Obviously, a switch with this core feature of the use of such structures in the stop area and/or in the aperture of a braking contact can also have other features, which are described in the preceding or in the following in conjunction with the different exemplary embodiments.

In the initial position and in the end position, the switching member can extend through one or a plurality of contacts in an aperture, wherein for producing an electrical contact, provision is made of a plurality of elastically configured contact elements distributed over the inner periphery on the inner wall of each aperture, which impinge on the outer periphery of the switching member. For this kind of contacting, use can be made of commercially available ready-made products, which are also called multi-contact elements and which form detachable electrical plug-in connections. These typically comprise elastic contact elements inserted in grooves. The grooves typically run in the axial direction in the inner wall of an aperture, through which the switching member extends in the contact position. Such a multi-contact element can be configured as an annular inset, which is inserted in a corresponding aperture in the respective contact of the contact unit in such a way that the electrical transition resistance between the contact and the inset is a minimal, and the inset or rather the multi-contact is held firmly in the contact. Such multi-contact connections enable extremely low transition resistances, are contact stable, and durable.

The general structure of a bar-shaped switching member, which interacts with at least two contacts that each have an aperture for the switching member in order to establish a contact between the respective contact and the switching member in one switching position of the switching member and to break the contact in another switching position, can also be used regardless of other features that relate to the drive or to the rest of the switching member (also in terms of the functionality thereof) for enabling a flexible design of the switch in terms of the function as a closer, opener, and/or toggle and/or junction switch. To this end, it is merely necessary to select the number and the positions of the contacts with respect to the switching member (taking into account the length and design thereof in terms of the number and the respective length of the contact parts and insulator parts of the switching member) so as to give rise to the desired functionality. In designing the switch in this regard, it is therefore necessary to ensure that, for a given number of contacts, the desired electrical contacts are always established or not established via the switching member in the initial position and in the end position, respectively.

Obviously, a switch with this core feature can also have other features that are described in the preceding or in the following in conjunction with the different exemplary embodiments.

BRIEF DESCRIPTION OF THE DRAWINGS

In the following, the invention shall be described in more detail with reference to exemplary embodiments illustrated in the drawings. Shown are.

DETAILED DESCRIPTION OF THE INVENTION

Figure 1A:
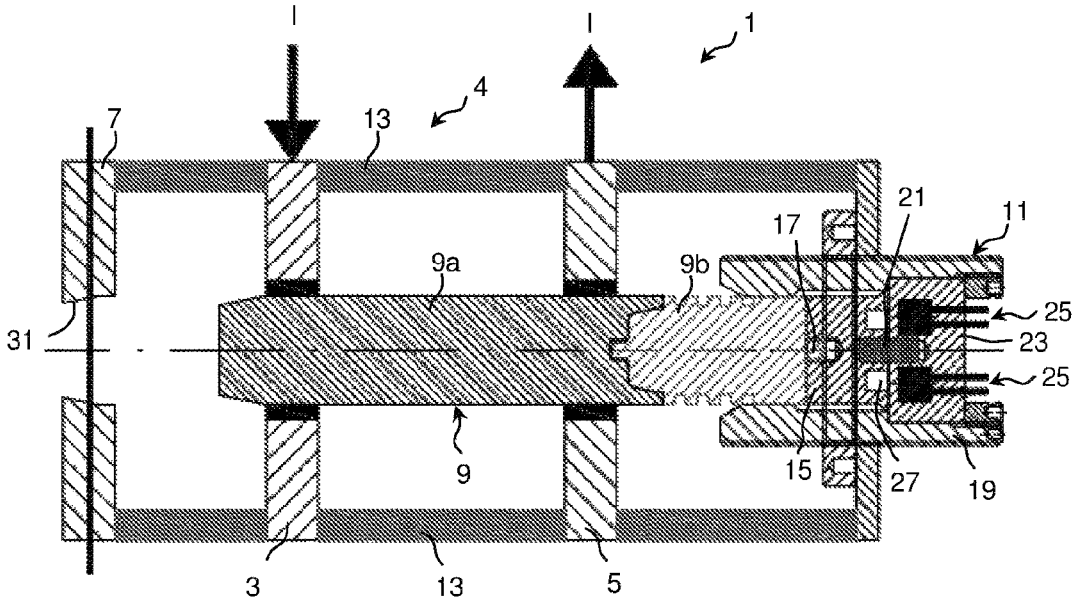
FIG. 1 a schematic illustration of a first embodiment of an electric switch according to the invention configured as a single-pole opener, with a pyrotechnic drive that directly drives the switching member, wherein the switching member is illustrated in the initial position (FIG. 1*a*) and in the end position (FIG. 1*b*)

FIG. 1 shows a schematic illustration of a first embodiment of an electric switch 1, which has two contacts 3, 5, a braking element 7, a switching member 9, and a drive 11 for the switching member 9, which in this embodiment is configured as a pyrotechnic drive 11. In the embodiment illustrated, the individual components of the electric switch 1 are connected via coupling elements 13 such that in each case there is a predefined distance between the individual components. Obviously, any number of coupling elements 13 can be provided. The respective position can also be varied as long as the functionality of the coupling elements 13 is ensured.

At this point it should be noted that the exact shape and structure of the individual components can obviously deviate from each of the variants illustrated in all of the drawings, as long as the respective function is ensured. In the present case, the figures are merely schematic figures that serve to explain the function of the switch concerned.

The pyrotechnic drive 1 illustrated in FIG. 1 has a drive element 15, which impinges on the rear end of the bar-shaped switching member 9. In the exemplary embodiment illustrated, the back end of the switching member 9 has an axial coupling pin 17, which engages in a corresponding blind recess in the front of the drive element 15, which acts as a piston. This connection serves to fix the switching member in the initial position of the electric switch 1 illustrated in FIG. 1 in order to prevent an accidental displacement of the switching member 9.

The drive element 15 of the drive 11 is arranged in a housing 19 so that it can slide in the axial direction of the switching member 9. FIG. 1*a* shows the drive element 15 in its initial position. In this position, the drive element 11 in turn is connected to the housing 19, or to a part of the drive 11 that is securely connected thereto, via a holding means 21. In the exemplary embodiment illustrated, the holding means 21 is configured as a pin-like element, which is received in an axial recess in the back face of the drive element 15 and in a recess in the front of a part 23 that is securely connected to the housing. The pin-like holding means 21 is received such that the holding means 21 does not release the drive element 15 until a certain minimal axial triggering force acts on the drive element 15 in the direction of the switching member 9. To this end, the pin-like holding means 21 can be pressed, screwed, or glued into the two recesses.

When the triggering force is reached, the holding means 21 is pulled out of one of the two recesses. However, in another variant the holding means 21 can also be configured such that it has a predetermined breaking point, for example centered between the drive element 15 and the housing part 23. In this case the predetermined breaking point and the securing of the holding means 21 in the two receiving recesses are embodied such that, upon reaching the triggering force, the holding means 21 breaks at its predetermined breaking point and releases the drive element 15.

In the pyrotechnic embodiment of the drive 11 illustrated in FIG. 1, a desired tamping effect is also ensured by the holding means 21. It is thereby ensured that the movement of the drive element 15 and thus of the switching member 9 only starts when a certain minimum force, namely the triggering force for releasing the holding means 21, is reached.

Obviously, the holding means 21 can also be produced in any other suitable manner, for example by a crimp connection of the drive element to the housing 19 or to the housing part 23, or by a shear pin that engages radially in the drive element 15 in the initial position thereof and that is sheared off once the triggering force is reached. An interlocking of the drive element 15 in the housing is also possible.

As illustrated in FIG. 1, the drive 11 comprises a triggering device 25, which can in particular be configured as electrically actuatable. The triggering device 25 is used to activate a pyrotechnic material, which is held in a receiving space 27 configured as an annular groove in the back face of the drive element 15. Obviously, the receiving space 27 can also or in addition be configured in the part 23 of the housing 19.

An activation of the pyrotechnic material thus generates a gas pressure, which exerts a corresponding axial compression force on the drive element 11 in the direction of the switching member 9.

As can be discerned from FIG. 1, the drive element 15 has, on its back end facing the housing part 23, a circumferential sealing edge 29 for ensuring a sufficient seal of the receiving space 27 with respect to the housing 19.

If the drive 11 is triggered by a corresponding actuation of the triggering device 25, a gas pressure is generated by the preferably deflagrating material of the pyrotechnic charge in the receiving space, which pressure initially increases rapidly as a consequence of the tamping effect of the holding means 21. When the triggering forces is exceeded, the holding means 21 releases the drive element 15. The drive element, which is coupled to the switching member 9 via the axial coupling pin 17, is thus slid in the axial direction of the switching member 9 with a sufficiently high switching velocity. The switching member is thereby moved from the initial position illustrated in FIG. 1*a* into the end position illustrated in FIG. 1*b*.

In the embodiment illustrated in FIG. 1, the switching member is composed of a front contact part 9*a* and a back insulator part 9*b*, which are securely connected to each other. The contact part 9*a* and the insulator part 9*b* can be connected to each other by providing a receiving recess in the back end of the contact part 9*a*, in which the front end of the insulator part 9*b* engages, as illustrated in FIG. 1. These elements can be connected by pressing-in, gluing, crimping, or the like.

The insulator part 9*b* of the switching member 9 ensures a sufficient insulation distance between the rear end of the contact part 9*a* composed of a conductive material. To this end, the insulator part 9*b* composed of an insulating material such as a plastic can be structured on its periphery in such a way that there is a longer route for surface currents or creeping currents. This can be accomplished by the machining of peripheral grooves, as shown in FIG. 1, which in longitudinal section give rise to a meandering path between the rear end of the switching part 9*a* and the front of the drive 11 or rather of the housing 19 of the drive 11.

Figure 1B:
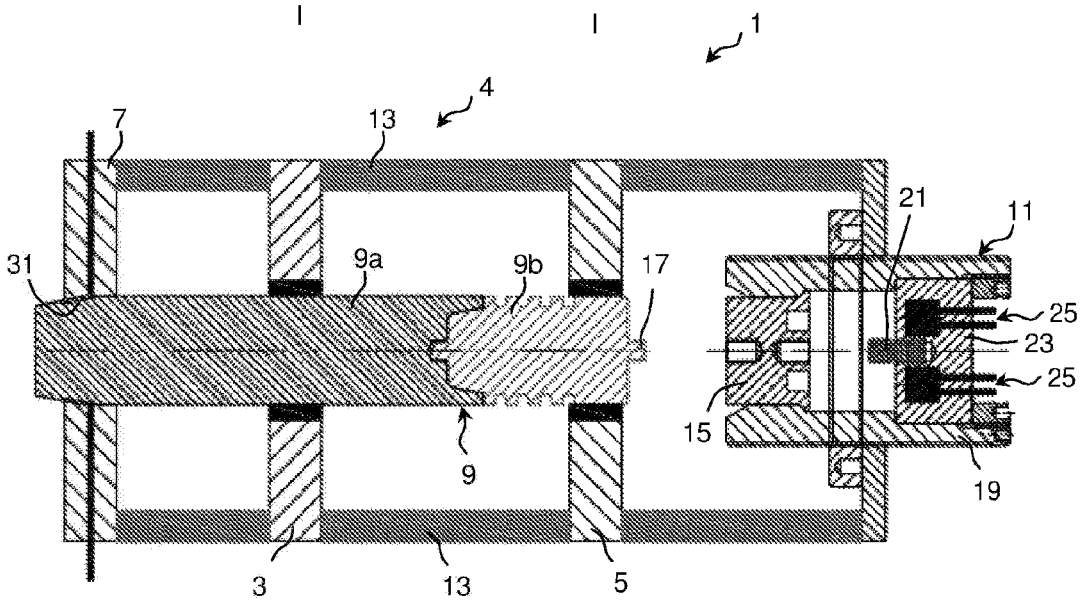

As can be discerned from FIG. 1*b*, the drive element 15 is stopped in its axial sliding movement after reaching an end position inside the housing 19 of the drive 11. To this end, the sealing edge 29 of the drive element 15 interacts with a stop shoulder between a front area of the housing 19 with a smaller diameter and another area inside the housing 19 with a larger diameter. The gas generated by a triggering of the pyrotechnic drive 11 is also present in the area with the larger diameter.

By suitably configuring the housing and the sealing edge 29 of the drive element 15, this space that receives the generated gas can be sufficiently sealed, even after the end position of the drive element 15 is reached, so that there is no danger of harm or injury to persons due to the escaping of the hot gas. In order to prevent the drive 11 from being continuously subjected to pressure after a triggering, provision can be made of small outlet openings for the gas in the housing, which are preferably small enough that no injury or harm whatsoever can occur as a result of the hot gas escaping. Such outlet openings can also be provided such that they only become effective in the end position of the drive element 15. For example, in the front area of the housing 19 with a smaller diameter, provision can be made of axially-running grooves that have a radial depth such that gas can escape from the interior to the front via the grooves, even with the sealing edge 29 in abutment with the shoulder between the space with the smaller and larger diameter.

As can be discerned in FIG. 1*b*, the connection of the switching member 9 or rather of the insulator part 9*b* of the switching member 9 to the drive element 15 via the coupling pins 17 is broken by the sudden stopping of the axial sliding movement of the drive element 15 such that the switching member 9, as a consequence of its inertia, continues to move with corresponding speed until it reaches its end position (FIG. 1*b*). The connection of the switching member 9 to the drive element 15 is thus designed such that practically none or only a negligible portion, or in certain cases also a desired portion of the kinetic energy possessed by the switching member 9 for breaking the connection is lost when the drive element 15 reaches its end position in the housing 19 of the drive 11.

The switching member 11 [sic] thus carries out a free movement phase after it has been uncoupled from the drive 9 [sic] or is no longer subjected to a force exerted by the latter. As a result, switching paths of practically any length are possible for the switching member 9. This is true because the switching path is no longer established by the movement path that can be provided by the drive 11.

In principle, it would also be possible to subject the switching member 9 or rather the insulator element 9*b* directly on its back side to the gas pressure of the drive 11. However, this would complicate the production of the unit consisting of the drive 11 and the switching member 9. Furthermore, it could no longer be ensured that the hot gases generated with a triggering of the pyrotechnic drive 11 would not reach the environment, at least not in such a way that there would be no danger of harm or injury.

In the embodiment of a switch 1 illustrated in FIG. 1, the movement path of the switching member 9 is limited by the separate braking element 7. The latter has, in the axis of the switching member that coincides with the movement axis of the switching member, an aperture 31 that is configured as conically tapering in its longitudinal section (viewed in the movement direction of the switching member), in other words the inner diameter of the aperture 31 narrows in the direction of the switching movement.

The front end of the switching member or rather of the contact part 9*a* is likewise conically configured, wherein the cone angle roughly corresponds to the cone angle of the aperture 31. For the desired braking of the switching member upon an engagement in the aperture 31, the minimum diameter of the aperture 31 must obviously be smaller than the maximum diameter of the switching member 9*a*, in the front area thereof. This gives rise to a relatively slow breaking of the switching part 9, which enters at high speed with its front end into the aperture 31 of the braking element 7. This relatively slow braking of the sliding movement of the switching member 9 results in lower mechanical stresses on the switch 1.

As can be discerned from FIG. 1, in the separate braking element 7 further provision is made of a sensor 33, which can be configured as, for example, a sensor wire. The latter runs perpendicular to the longitudinal axis of the switching member 9 in an area chosen such that the sensor 33 will be destroyed when the switching member 9 enters the aperture 31. Thus, a signal can be generated by a simple resistance measurement as soon as the switch has been triggered. The signal then contains the information that the switch was actually triggered and that the switching member 9 has reached its correct end position.

In the embodiment of the switch 1 illustrated in FIG. 1, the two contacts 3 and 5 are connected in an electrically conductive manner in the initial position (FIG. 1*a*). This is indicated by the respective arrows for a current I flowing through the switch. The contacting of the contacts 3, 5 of the switch 1 can obviously take place in any suitable fashion.

In the end position illustrated in FIG. 1*b*, the switching member 9 has been moved far enough into its end position such that the contact part 9*a*, which connects the two contacts 3, 5 in an electrically conductive manner in the initial position illustrated in FIG. 1*a*, is no longer in electrical contact with the contact 5. In the end position, the electric switch 1 configured as an opener has thus broken the electrical circuit via the contacts 3 and 5.

In its end position, the switching part is still held with its insulator part 9*b* in the contact 5 in the embodiment illustrated in FIG. 1. This enables the achievement of sufficient stability, in particular with large switches 1 and consequently large switching members 9. The insulator part 9*b* is thus dimensioned such that a sufficient minimum insulation distance is ensured between the switching part 9*a* and the contact 5, even in the end position in FIG. 1*b*.

Owing to the long displacement path that is made possible by the free movement phase of the switching member 9 after it is uncoupled from the drive 11, the cycle distances between the contacts 3, 5 can also be sufficiently large such that the switch can also be used for high voltages, in particular voltages greater than 10 kV, which are present at the contacts after the electrical circuit is opened. Furthermore, with appropriate dimensioning of the insulator part 9*b* large distances are also possible between the contact unit 4 and the drive 11. This is particularly important if the maximum switching voltage that may be present at the contact unit 4 or rather the contacts 3, 5 is not excessively high but nevertheless is at a much higher potential than the drive unit 11.

At this point it should be noted that the switch 1 can obviously be produced in any suitable size. This depends in particular on the voltage and the amperage to be switched. The size can range from small construction sizes for voltages ranging from a few tens to a few hundreds of volts to large construction sizes for voltages of several thousand, several tens of thousands, or even several hundreds of thousands of volts. In large switches the switching member can easily be as long as one to several meters.

In the switch 1 illustrated in FIG. 2, the drive 11 is already arranged, in the initial position of the switching member 9, in a position remote from the back end of the switching member 9, in other words the drive 11 is no longer impinging directly on the switching member 9.

The pyrotechnic drive 11 in the embodiment according to FIG. 2 is essentially identical to the drive 11 of the variant in FIG. 1. But unlike this variant, the drive 11 contains a momentum transfer element 35, which is received in the front area of the housing 19 of the drive 11. Like the insulator part 9*b* of the variant according to FIG. 1, the momentum transfer element 35 can be connected to the drive element 15 in order to prevent an unnecessary detachment of the momentum transfer element 35 from the drive 11.

Figure 2A:
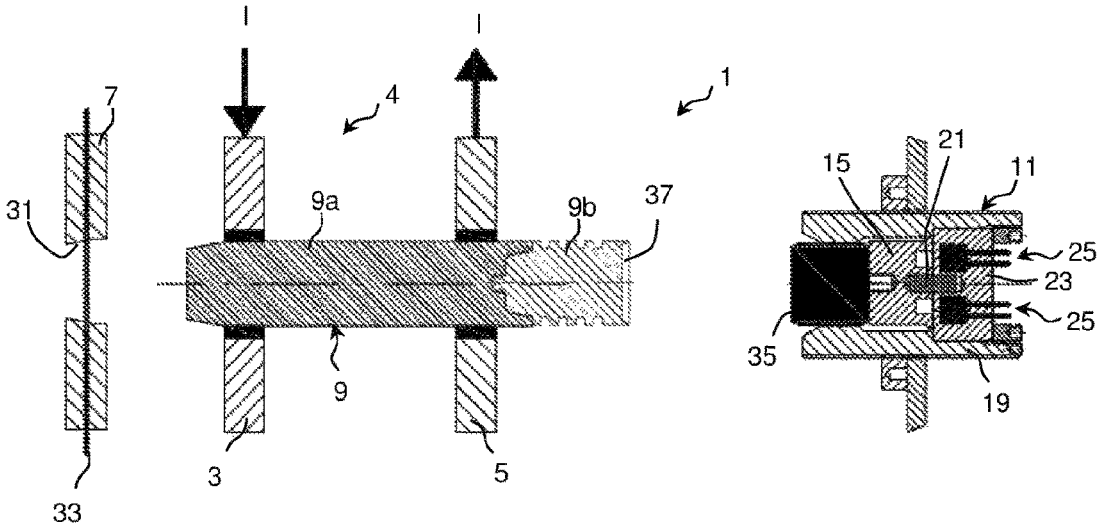
FIG. 2 a schematic illustration of a second embodiment of an electric switch according to the invention configured as a single-pole opener, with a pyrotechnic drive that indirectly drives the switching member via a momentum transfer element, wherein the switching member is illustrated in the initial position (FIG. 2*a*) and in the end position (FIG. 2*b*)
Figure 2B:
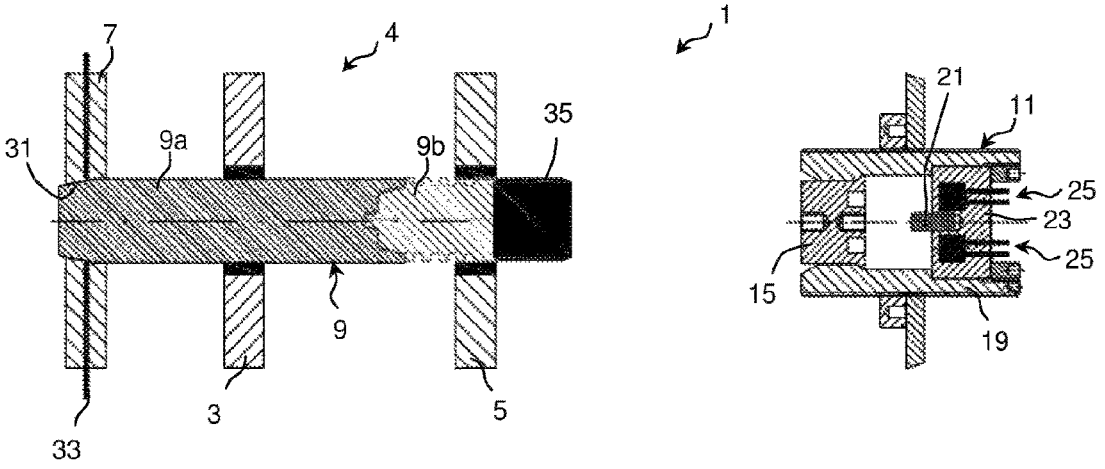

The momentum transfer element 35 is configured such that it has a sufficient mass for being able to transfer a correspondingly large momentum to the switching member 9, wherein as a consequence of this indirect impingement by means of the drive 11, the switching member 9 is accelerated and moved from its initial position (FIG. 2*a*) and into its end position (FIG. 2*b*).

The function of the switch 1 illustrated in FIG. 2 is thus largely identical to the function of the switch according to FIG. 1. The only difference lies in the fact that the switching member 9 is no longer directly impinged upon by the drive 11, but that the drive 11, when triggered, accelerates the momentum transfer element 35 and shoots it like a projectile at the back end of the switching member 9 or rather of the insulator part 9*b*.

In order to prevent the momentum transfer element 25 [sic] from flying around in an uncontrolled manner or lying about in the switch 1 after it impacts the switching member 9, the switching member, in particular the insulator part 9*b*, and the momentum transfer element 35 can be configured such that the momentum transfer element 35, after impacting the back end of the switching member 9 or rather of the insulator part 9*b*, is joined thereto. To this end and as indicated in FIG. 2*a*, the back face of the insulator part 9*b* can have a small recess or cutout 37, in which the front of the momentum transfer element 35 engages during its impact. As an alternative or in addition, the materials of the switching member 9 or rather of the insulator part 9*b* and of the momentum transfer element 35 can be chosen such that the momentum transfer element 25 [sic] fuses with the switching member 9 or rather with the insulator part 9*b*. In this case the switching member 9 and the momentum transfer element 35 jointly move toward the end position (FIG. 2*b*).

In the embodiment of the switch 1 illustrated in FIG. 2, the switching member 9 is thus indirectly driven by the drive through momentum transfer by means of the momentum transfer element 35. This give rise to the advantage that the drive 11 no longer has to be positioned directly at the end of the switching member 9, in the initial position thereof. In particular, with large switches for very high voltages, this makes distances of several meters between the contact unit 4 and the drive 11 possible. Such switches can thus also be used in cases in which a very high potential difference can arise between the contact unit 4 or rather the contacts 3, 5 and the drive 11. In particular, it is no longer necessary to design the drive 11 such that the latter is at the same potential as the contact unit 4. Even a potential separation is possible.

At this point it should be noted that in FIG. 2, the coupling elements 13 between the contacts, the braking element, and the drive are not illustrated. Obviously, any suitable measure can be employed for mounting these components.

Figure 3A:
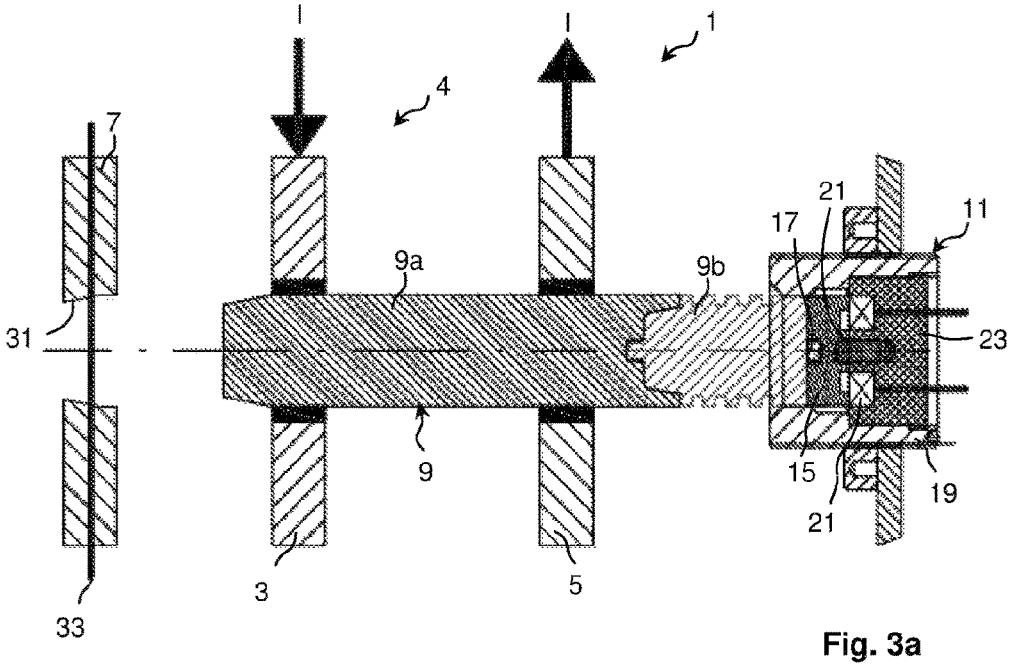
FIG. 3 a schematic illustration of a third embodiment similar to the embodiment in FIG. 1, in which the drive is configured as an electrodynamic drive.
Figure 3B:
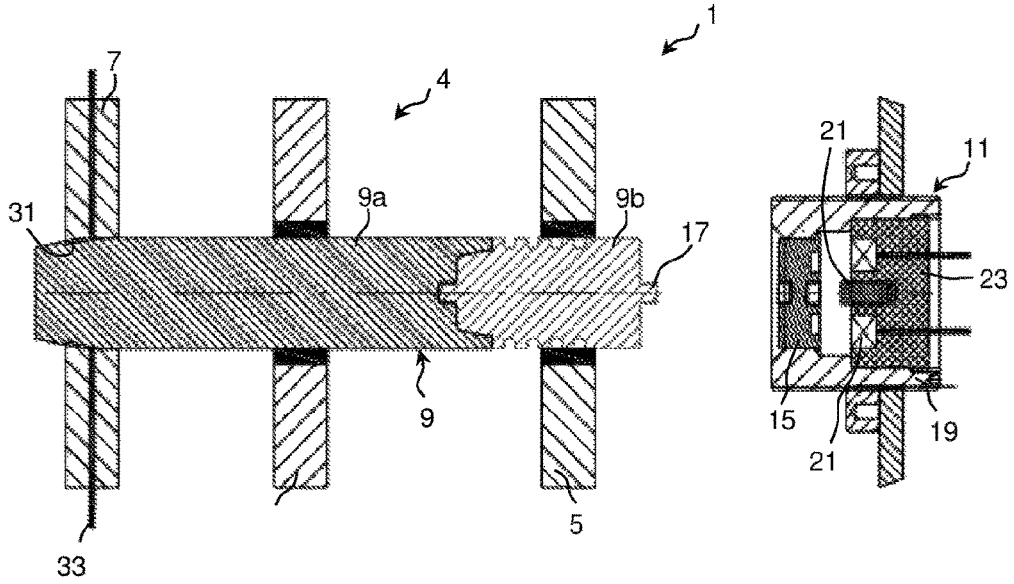

The embodiment according to FIG. 3 corresponds largely to the embodiment according to FIG. 1. However, this switch 1, which is also configured as a single-pole opener, comprises an electrodynamic drive 11 rather than a pyrotechnic drive 11. Such an electrodynamic drive 11 can comprise, for example, a coil 39 that is subjected to a short current pulse with a very high amperage. A magnetic field is thus generated, which generates eddy currents in the appropriately designed drive element 15, which in turn give rise to a repelling magnetic field. With sufficiently high amperages through the coil 39, the drive element 15 (as is also the case of a pyrotechnic drive) is moved with corresponding force and speed from its initial position into its end position (FIG. 3*b*).

The switch 1 in FIG. 3 otherwise functions in the same manner as the switch 1 in FIG. 1. Only the insulator part 9*b* projects to some extent toward the drive 11 out of the aperture in the contact 5 in the end position of the switching member 9 as a result of a slightly different dimensioning of the distances between the contacts or rather of the lengths of the contact part 9*a* and of the insulator part 9*b*.

Figure 4A:
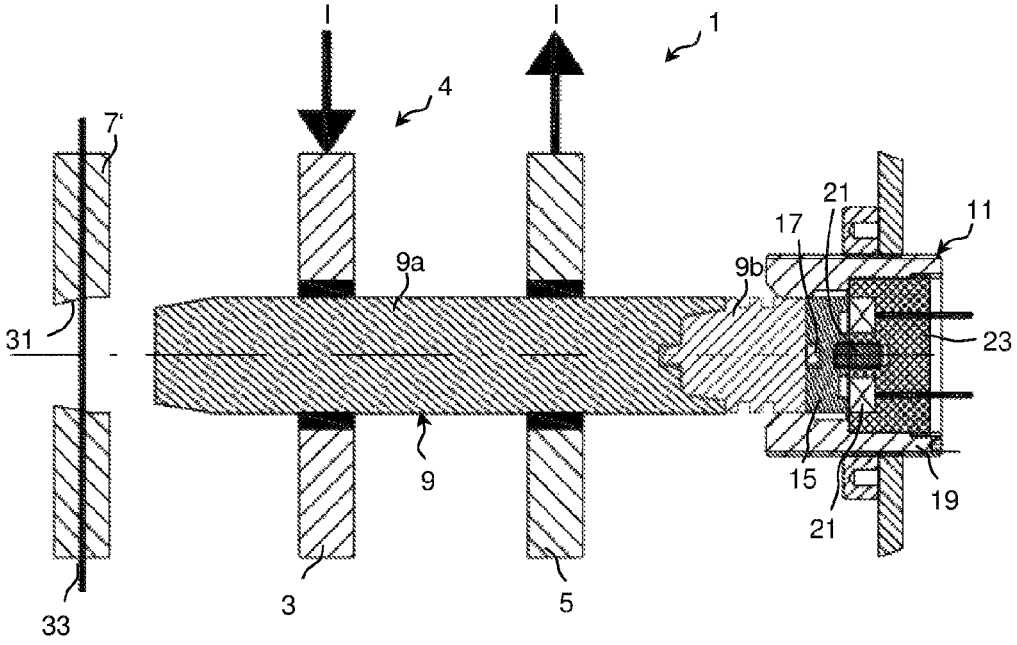
FIG. 4 a schematic illustration of a fourth embodiment of an electric switch according to the invention configured as a single-pole junction switch, with an electrodynamic drive that directly drives the switching member, wherein the switching member is illustrated in the initial position (FIG. 4*a*) and in the end position (FIG. 4*b*)
Figure 4B:
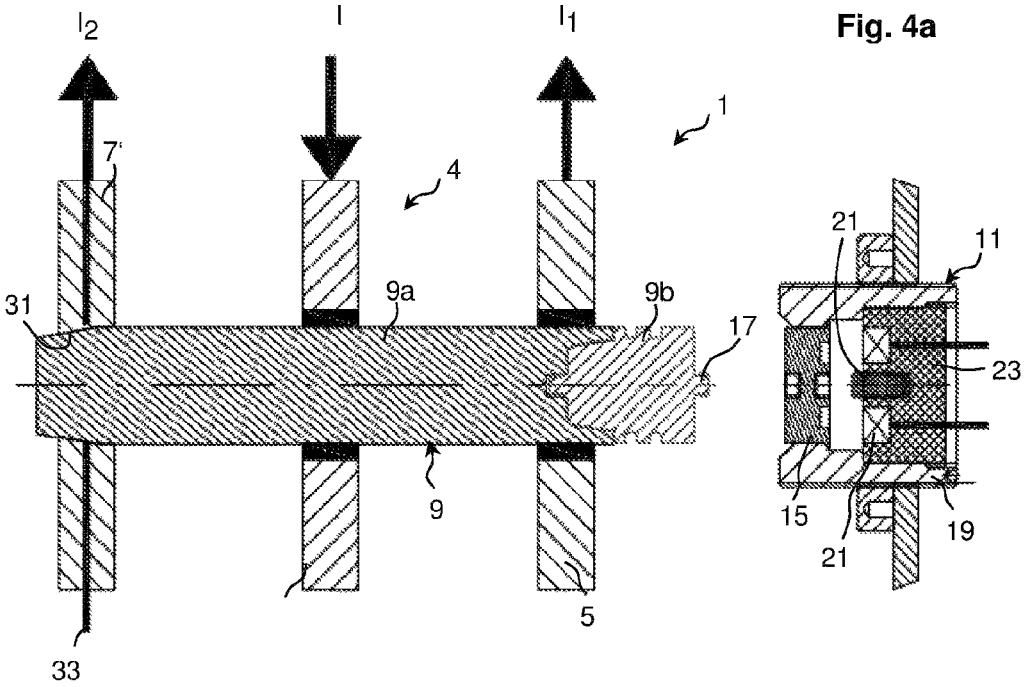

The switch 1 according to the embodiment illustrated in FIG. 4 essentially differs from the embodiment in FIG. 3 by another dimensioning of the switching member 9 in terms of the lengths of the contact part 9*a* and of the insulator part 9*b*, with respect to the distances of the contacts 3, 5 and of the braking element 7. For as can be discerned from FIG. 4, this switch 1 functions as a junction switch. In the initial position according to FIG. 4*a*, the contact part 9*a* short circuits the two contacts 3 and 5 or rather establishes an electrical contact between them. In the end position of the switching member 9, as can be discerned from FIG. 4*b*, there is still an electrical contact between the contacts 3 and 5 because the contact part 9*a* of the switching member 9 is configured with appropriate length. In addition, the braking element in this embodiment is configured as a braking contact 7'. In the end position of the switching member 9, the middle contact 3 is thus short circuited with the two contacts 7' and 5 such that a current I fed to the contact 3 is split into partial currents I1 via the contact 5 and 12 via the braking contact 7'.

Figure 5A:
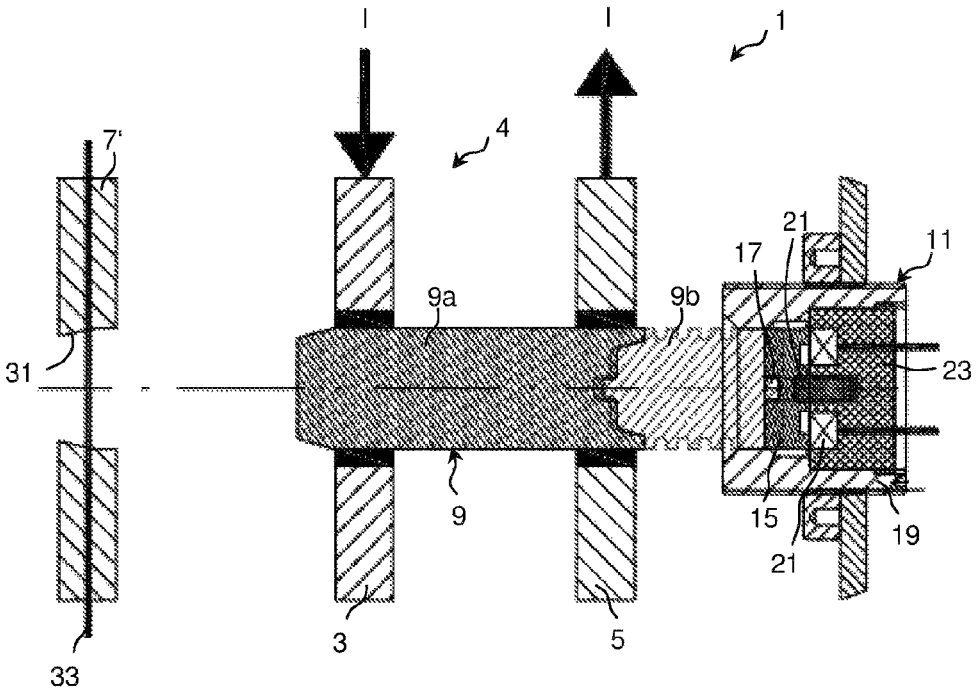
FIG. 5 a schematic illustration of a fifth embodiment of an electric switch according to the invention configured as a single-pole toggle switch, with an electrodynamic drive that directly drives the switching member, wherein the switching member is illustrated in the initial position (FIG. 5*a*) and in the end position (FIG. 5*b*)

The switch 1 of the embodiment according to FIG. 5 also has an electrodynamic drive 11, which impinges directly on the switching member 9 in its initial position (and during the acceleration phase). The mechanical functioning is therefore largely identical to that of the embodiment according to FIG. 4. However, in this case the switching member is dimensioned in terms of its axial division into the contact part 9*a* and the insulator element 9*b* such that in the initial position (FIG. 5*a*), only the contacts 3 and 5 are short circuited, whereas in the end position, only the contacts 3 and 7' are. This switch is therefore a toggle switch.

As in the embodiment according to FIG. 4, the braking contact 7 can obviously contain a sensor 33 in the form of, for example, a sensor wire, a sensor film, in particular a polyvinylidene fluoride (PVDF) film or PVDF wire, or an optical fiber.

Figure 5B:
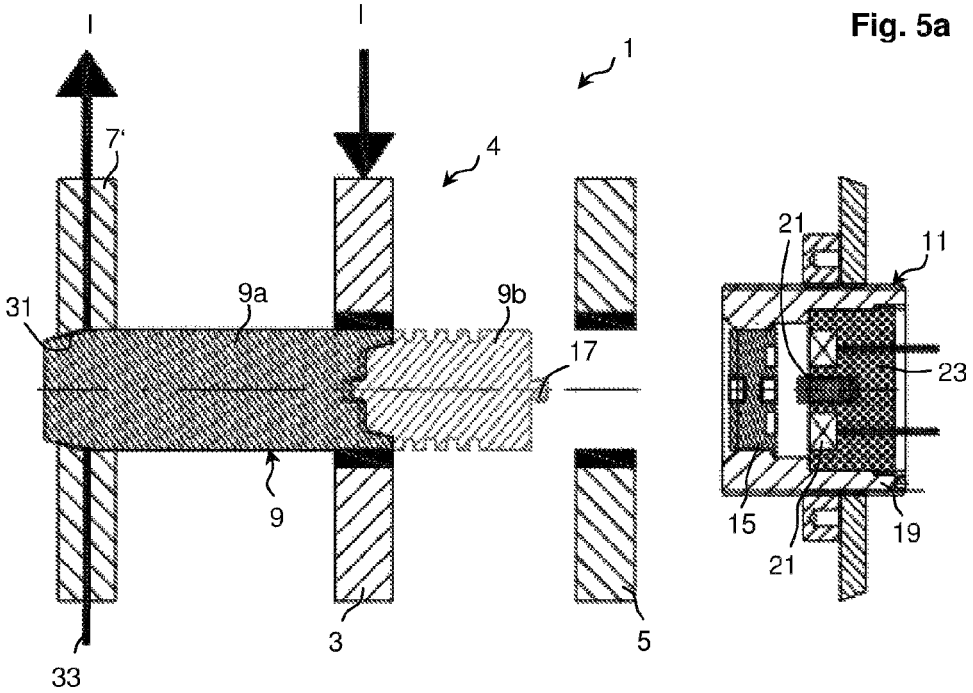

As can be discerned in FIG. 5*b*, in this switch 1 the dimensioning of the switching member with respect to the contact unit 4 is such that in the end position, the insulator part is no longer held in the contact 5.

Figure 6A:
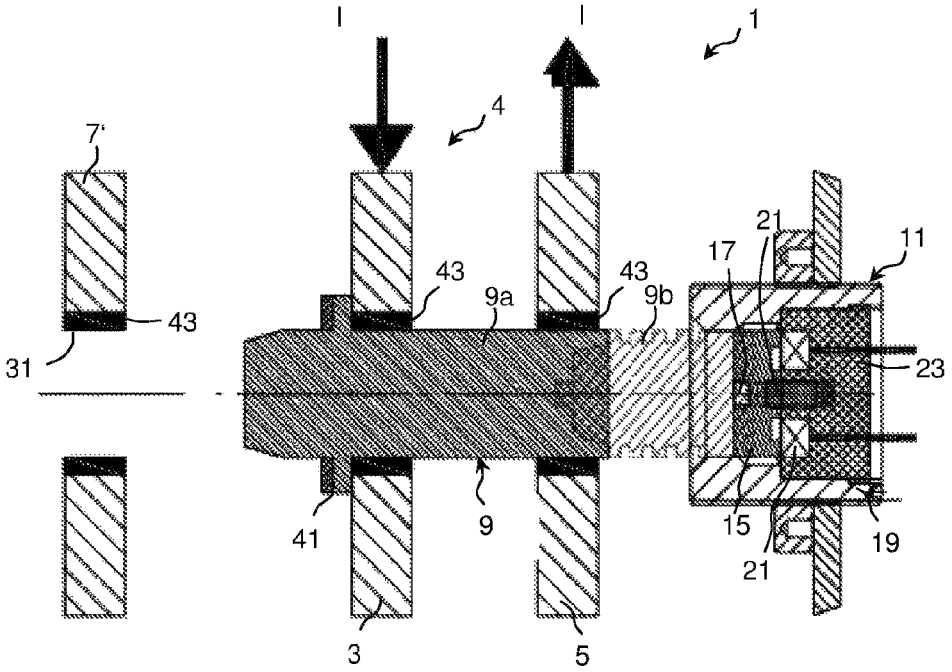
FIG. 6 a schematic illustration of a sixth embodiment similar to the embodiment in FIG. 5, in which the stop area of the switching member has a radial stop flange.
Figure 6B:
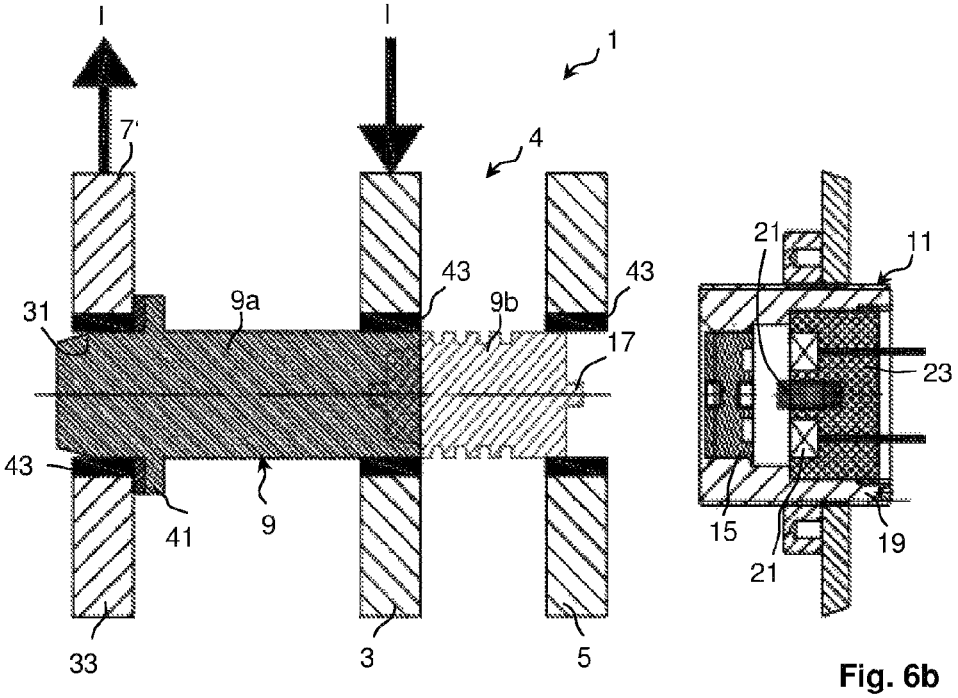

In this regard, the switch 1 according to the embodiment illustrated in FIG. 6 shows a variant in which there is an additional means of holding the insulator part 9*b* in the end position. This switch also performs a toggle function and corresponds largely to the variant according to FIG. 5.

However, unlike the embodiments described in the preceding, the contact part 9*a* in the braking contact 7' is not braked via a conical aperture and the conical front end of the switching member 9, but by a stop flange 41 extending over the periphery of the front end of the contact part 9*a* of the switching member 9. As can be discerned from FIG. 6, the front of the stop flange 41 can be covered with a shock absorbent material, for example a plastic, in order to design the braking of the switching member 9 so that it is somewhat slower than would be the case with a completely rigid stop flange.

In order to ensure a secure electrical contact between the contact part 9*a* and the braking contact 7 in this case, the braking contact 7 has contacting means 43, which can also be used in the same manner as the other contacts, which must effect an electrical contact before as well as after the sliding movement of the switching member 9. Obviously, such contacting means 43 can also be used with such contacts that only need to be electrically connected to the switching member in either the initial position or in the end position of said switching member 9.

The contact means 43 can in particular be configured as a so-called multi-contact. On the inner wall of the respective aperture in the contact 3, 5, 7', a multi-contact typically has elastic elements that are arranged distributed over the inner periphery. The elastic elements are electrically connected to the respective contact 3, 5, 7' on one end and impinge on the outer periphery of the switching member 9 or rather of the contact part 9*a* with the other end. A secure contact is thus ensured. Such multi-contacts are commercially available as ready-made components and can be configured as ring-shaped, for example. There can be axial grooves, in which the elastic contact parts are disposed, running in the inner wall of the ring, wherein the contact parts protrude, with a free end, in the radial direction above the inner circumference of the ring. The outer periphery of the switching member or rather of the contact part 9*a* is such that it essentially corresponds to the inner circumference of the ring of the multi-contact. The outer periphery of the switching member is thus securely impinged on by the elastic contact elements. Such a multi-contact also permits a repeated inward and outward sliding or movement of the switching member while simultaneously maintaining the electrical contact between the switching member 9 or rather the contact part 9*a* and the respective contact part 3, 5, 7'.

Figure 7:
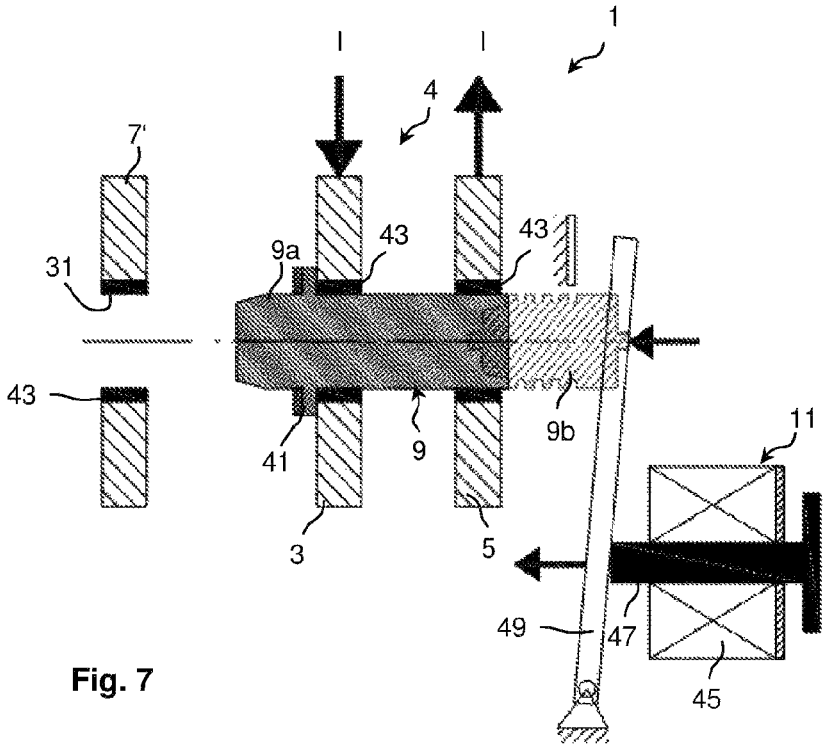
FIG. 7 a schematic illustration of a seventh embodiment similar to the embodiment in FIG. 6, in which the electrodynamic drive comprises a lever mechanism.

In terms of the contact unit 4 and the switching member 9, the switch 1 illustrated in FIG. 7 corresponds to the embodiment according to FIG. 6. However, in lieu of an electrodynamic drive, in this case use is made of a drive 11 that comprises a plunger coil 5, in which an actuator element 47 engages. The actuator element has a flange on its end, the ferromagnetic material of which flange is attracted by the magnetic field generated by the plunger coil 45 when a sufficiently high current is applied to the plunger coil 45. This actuates a lever mechanism, which impinges on a one-sided lever 49. With its longer lever arm, the lever 49 impinges on the switching member 9, on the back end thereof, in other words on the back end of the insulator part 9*b*. The switching path created by the plunger coil 45 is thus transmitted. The functionality of this switch 1 otherwise corresponds to that of the variant according to FIG. 6.

Figure 8:
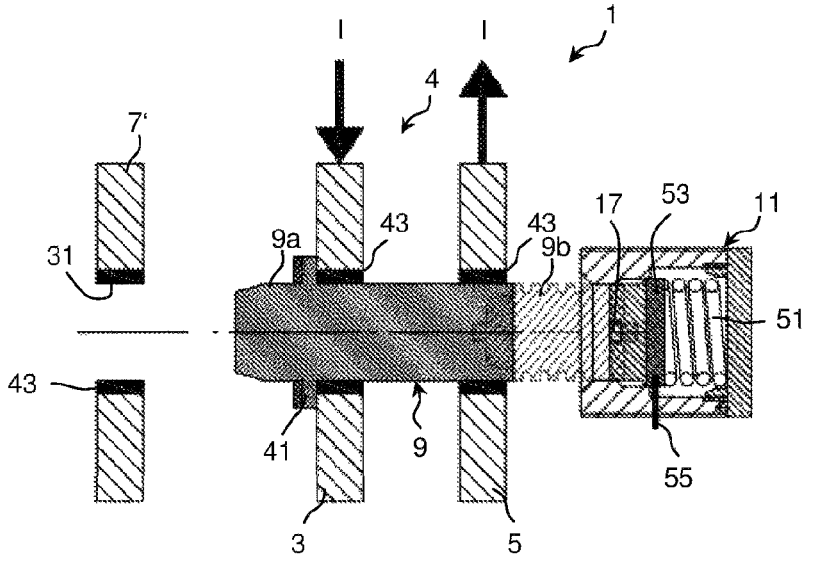
FIG. 8 a schematic illustration of an eighth embodiment similar to the embodiment in FIG. 6, in which the drive comprises an elastic element as an energy storage unit.

FIG. 8 shows another variant of a drive 11, which has a compressed helical spring 41 as an energy storage unit. With one end, this spring impinges on the drive element 15 via a pressure plate 53. Obviously a direct impingement of the drive element 15 would also be possible.

The pressure plate can be released in its axial mobility by a triggering device. Obviously, a manual or controlled triggering is also possible, depending upon the configuration of the triggering device 55. A controllable triggering device can be configured such that, for example, a pin engaging radially in the pressure plate is moved from a locking position into a release position by means of an electromagnet of the triggering device 55.

Here again, the functionality of this variant of a switch 1 otherwise corresponds to that of the embodiment in FIG. 6 or FIG. 7.

Figure 9A:
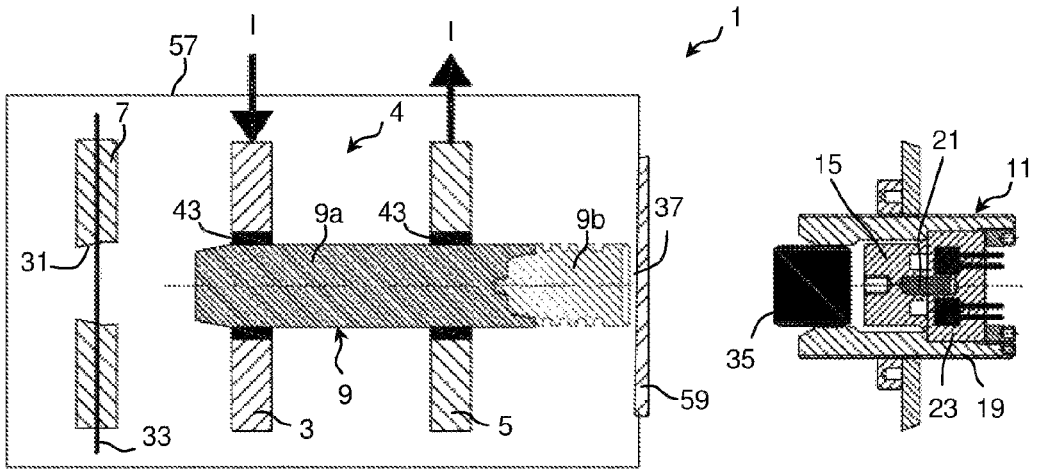
FIG. 9 a schematic illustration of a ninth embodiment similar to the embodiment in FIG. 2, in which the contact unit is arranged in a sealed housing.
Figure 9B:
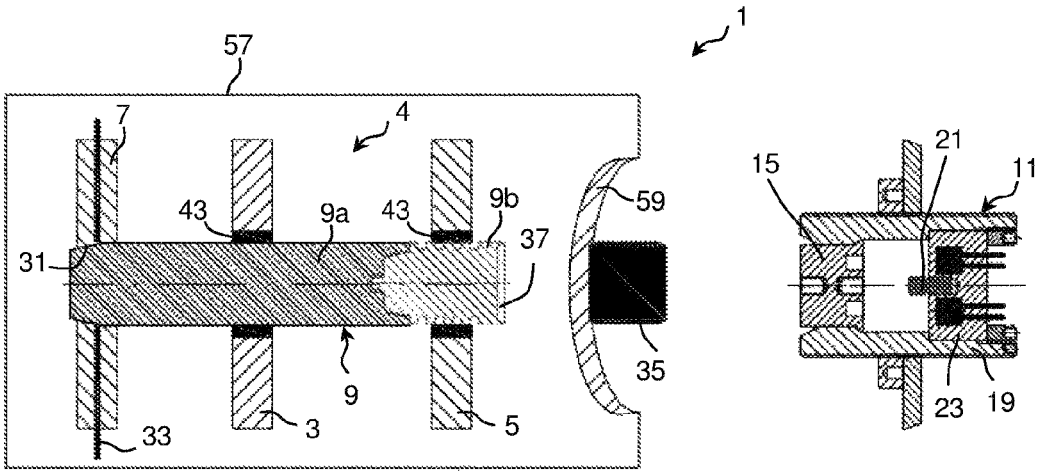

FIG. 9 shows another embodiment of an electric switch 1, in which the contact unit 4 and the switching member 9 are arranged in a sealed housing 57. With its back end, the switching member 9 essentially extends to a deformable membrane or membrane area of the housing 57. As a drive, here again use is made of a pyrotechnic drive 11, which is configured for indirectly impinging on the switching member 9 by means of a momentum transfer element 35, as in the case of the embodiment according to FIG. 2.

When the drive 11 is triggered, the momentum transfer element 35 is no longer fired directly onto the back face of the switching member 9 or rather of the insulator part 9*b*, but onto the interposed membrane 59. In this case the momentum is thus transferred indirectly from the momentum transfer element 35 to the switching member 9 via the membrane 59.

The membrane is preferably configured and adapted to the momentum to be transferred such that it deforms during the momentum transfer. The momentum transfer element can thus be braked more slowly.

It is also possible to design the membrane and the momentum transfer element 35 such that the momentum transfer element, after impacting the membrane 59, becomes joined to the latter, for example by the provision of a corresponding receiving means or by a fusion of the respective materials due to the impact force.

The functionality of the switch 1 illustrated in FIG. 9 otherwise corresponds to the functionality of the variant in FIG. 2.

Figure 10:
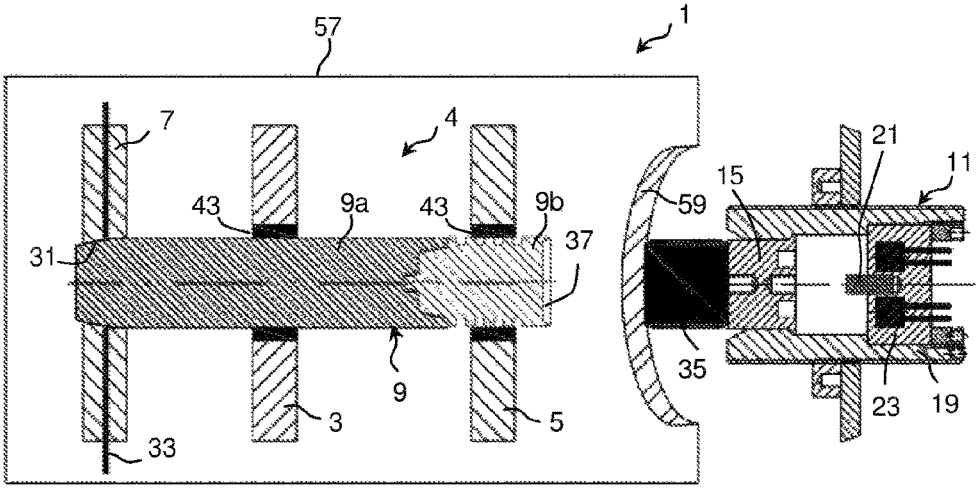
FIG. 10 a schematic illustration of a tenth embodiment similar to the embodiment in FIG. 9, in which the drive impinges on the switching member directly via a housing membrane.

The embodiment illustrated in FIG. 10 corresponds largely to the embodiment in FIG. 9, except that the drive 11 in the initial position (i.e., in the non-triggered state) has been moved closer to the housing 57 such that the momentum transfer element is already impinging with its front on the membrane 59. Hence there is practically a direct impingement of the switching member 9 by the drive 11 because the switching member is in contact with the membrane 59 in the initial position.

Figure 11:
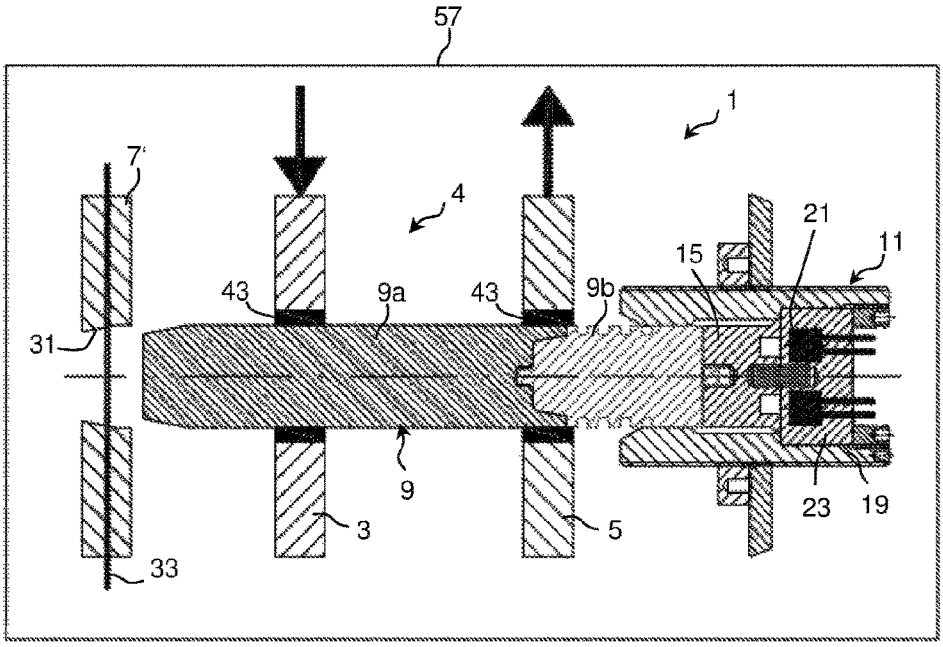
FIG. 11 a schematic illustration of an $11^{th}$ embodiment similar to the embodiment in FIG. 1, wherein the switch has a sealed housing in which the drive, the contact unit, and the switching member are arranged.

In terms of functionality, the embodiment of a switch 1 according to FIG. 11 corresponds to the embodiment in FIG. 1. Compared to the variant in FIG. 1 (as in the other variants according to FIGS. 2-10, the coupling elements 13 are not illustrated in FIG. 11), additional provision is made of a housing 57 that not only surrounds the contact unit 4, but also the entire switch 1.

Figure 12A:
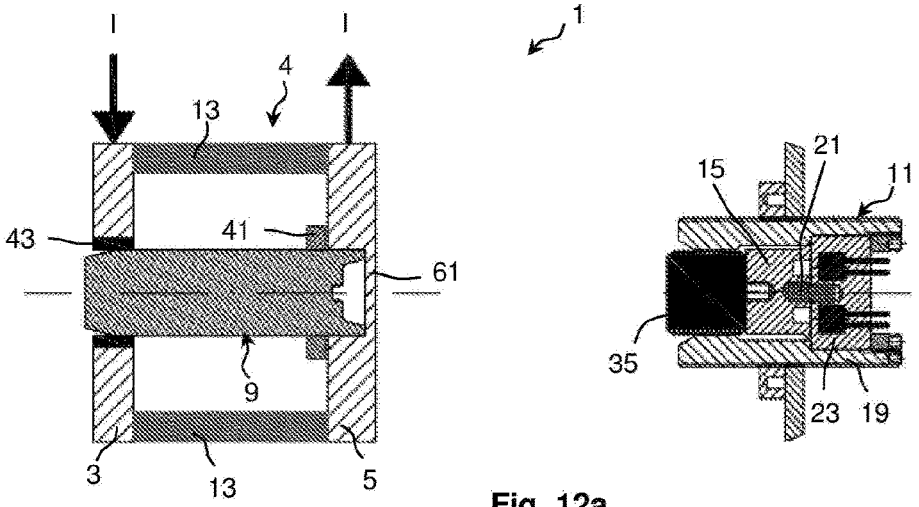
FIG. 12 a schematic illustration of a $12^{th}$ embodiment similar to the embodiment in FIG. 2, wherein the switching member is pressed with its back end into a blind recess in the back contact.

FIG. 12 shows a switch 1 in which here again use is made of a pyrotechnic drive 11, which is configured to transfer a momentum by means of a momentum transfer element 35 to the switching member 9 of a contact unit 4. This contact unit 4 only comprises a first contact 3 and a second contact 5. An additional braking element or sensor has been dispensed with in this case. The switching member 9 has a stop flange 41, which is used to brake the switching movement at the contact 3. Here too the contact 3 contacts the switching member 9 via contact means 43 such as a multi-contact, for example.

Figure 12B:
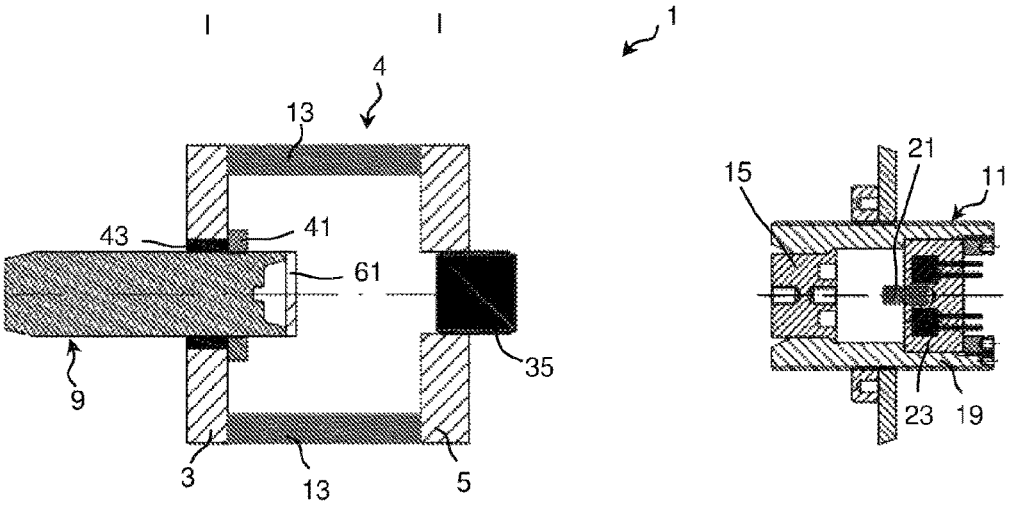

A unique feature with this contact unit is the fact that the switching member 9 is held with its back end in a receiving recess in the back contact 5. In this case the contact element can be, for example, pressed in during the production. With its back side, the stop flange 41 can also serve as a delimitation for a pressing-in. Hence only a thin wall forming a break-out area 61 remains on the bottom of the receiving recess of the contact 5. When the contact transfer element 35 [sic] impacts the break-out area 61, the latter is broken out of the contact 5 and the momentum (at least a sufficiently large portion thereof) of the momentum transfer element 35 is transferred to the switching member 9. The switching member 9 is then moved into its end position, which is illustrated in FIG. 12*b*. The wall or rather the break-out area 61 may be fused to the back side of the switching member 9 as a result of the impact force.

As illustrated in FIG. 12*b*, in terms of its geometry the momentum transfer element 35 can be designed such that, or the recess or the resulting aperture in the contact 5 can be adapted to the momentum transfer element such that the momentum transfer element is caught in the resulting aperture.

Figure 13A:
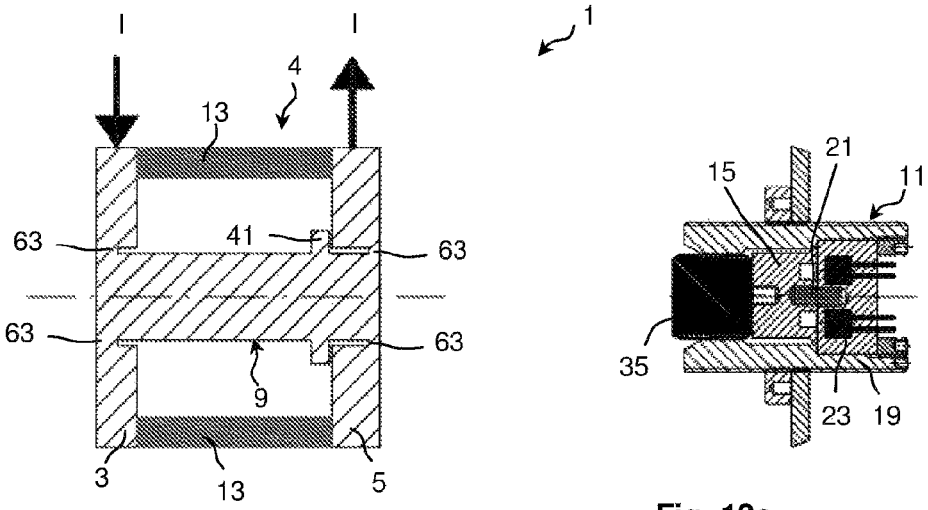
FIG. 13 a schematic illustration of a $13^{th}$ embodiment similar to the embodiment in FIG. 12, wherein the switching member and the two contacts are configured as a single piece and wherein predetermined breaking points are provided between the switching member and the contacts.
Figure 13B:
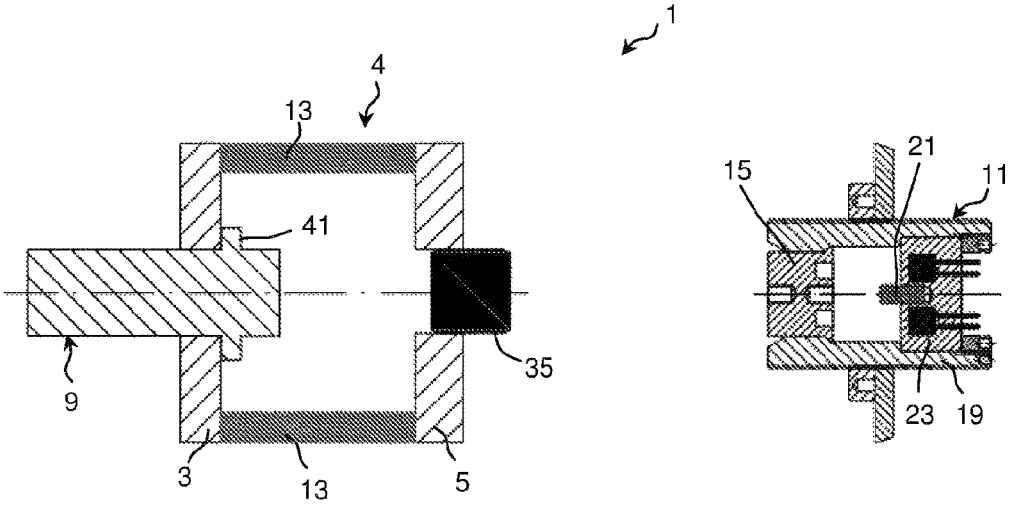

The switch in FIG. 13 differs from the embodiment according to FIG. 12 only in the fact that the contact unit 4 is configured in a different manner. In this case the switching member 9, which as in the variant according to FIG. 12 likewise consists of just one contact part (there is no insulating section), and the contact 5 are configured as a single piece. The contact 5 can thus be produced with the switching member 9 in the same process. It is only necessary to provide an appropriate thin spot in the contact, which constitutes a predetermined breaking point between the switching member 9 and the contact 5.

In the embodiment according to FIG. 13, the front contact 3 and the switching member are also configured as a single piece. In this case too provision is made of a thin spot 63 between the switching member and the contact.

In the variant illustrated in FIG. 13, the thin spot 63 can be produced by, say, a welding process if the switching member 9 is inserted in an initially existing aperture in the contact 5.

If the stop flange 41 is not located directly on the contact 5, then obviously a cutting or machining process can be used to produce the thin spot in the contact 5. It is furthermore possible to produce a part as complex as the one shown in FIG. 13*a* in one piece with so-called rapid prototyping techniques. This is also possible for metal materials.

Figure 14:
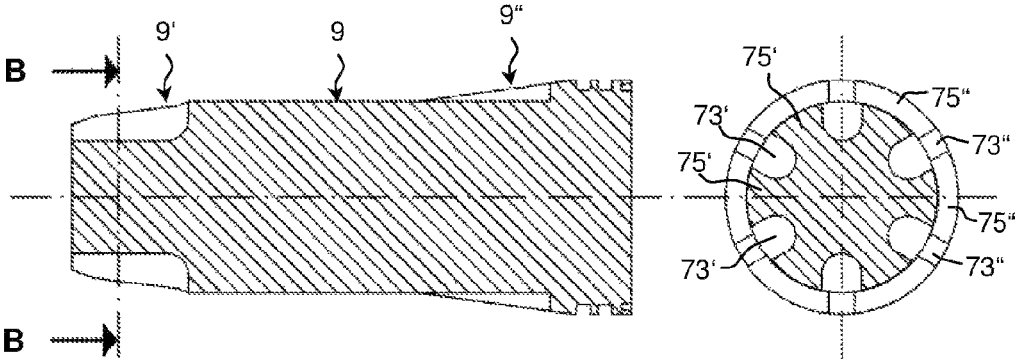
FIG. 14 a longitudinal section through a switching member with structured stop areas.

FIG. 14 shows a switching member 9 with a front area 9' having a structured periphery and another area 9" also having a structured periphery. The switching member 9 illustrated here, which is only a contact part and is therefore composed of an electrically conductive material, can obviously also be prolonged to the right, also by means of an insulator part. The structured areas 9', 9" are each provided to effect a secure electrical contact when the switching member 9 is thrust into corresponding contacts (not illustrated). In the embodiment illustrated here, the structurings consists of grooves 73' and 73" and raised projections 75' and 75", respectively, as can be discerned from the section B-B in FIG. 14. The switching member 9 can engage by these structured stop areas in corresponding apertures in two braking contacts such that the latter become connected for electrical conductivity when the switch is triggered. The structuring thus enables a material flow, in particular of the material of the projections of the structures, into the areas in which there is initially no material. The material flow is brought about by the high pressure, the friction, and the temperature thus generated. The front area 9' of the switching member 9 in FIG. 14 can be used in conjunction with the switching member according to FIG. 5, for example. The structured area 9' thus designed being thrust into the braking contact 7 gives rise to a material flow and, as a consequence of the high temperature and the softening of the material, a fusion of the structured area 9' with the inner wall of the aperture of the braking contact 7.

The structuring is thus a very decisive factor in the establishment of a secure contact and for the desired fusion of the materials of the switching member and of the braking contact. The back structured area 9" can also be used to establish a secure electrical contact with a second contact (not illustrated). In an initial position, the switching member 9 according to FIG. 14 can thus already be engaged in an initially currentless (that is, unused) braking contact in such a way that the area of the switching member 9 between the two structured areas 9' and 9" is located in the aperture of the contact that is to be contacted by means of the structured area 9" in the end position of the switching member.

The switching member 9 according to FIG. 14 thus makes it possible to establish two secure electrical, optionally fused connections between the switching member 9 in the two structured areas 9' and 9" and one contact in each case.

Figure 15:
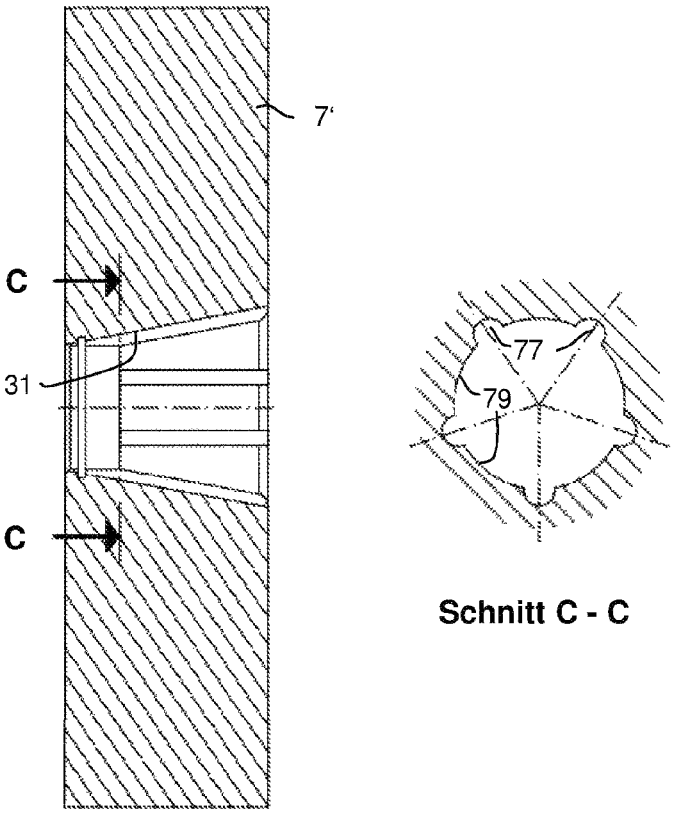
FIG. 15 a sectional view of a braking contact or of a separate braking element with a structured aperture for receiving the stop area of a switching member.

In lieu of or in addition to a structuring of the switching member 9 in an area or axial section of said switching member 9 in which a contacting or fusion with the inner wall of a corresponding contact is desired, the inner wall of the respective aperture in a braking contact 7' can also be provided with a structure. In lieu of or in addition to the material flow in the structured area of the switching member 9, material flows will also be generated in the area of the inner wall of the aperture in the respective contact. Such a structured aperture in a braking contact 7' is illustrated in FIG. 15. The aperture with a conical progression in axial section has essentially axially running grooves 77 on its inner wall. These grooves 77 form gaps into which deforming material supplied by a softening or melting of the material of the projections 79 can flow.

Instead of grooves, obviously any other structuring that creates appropriate gaps for receiving softening material is conceivable.

Figure 16A:
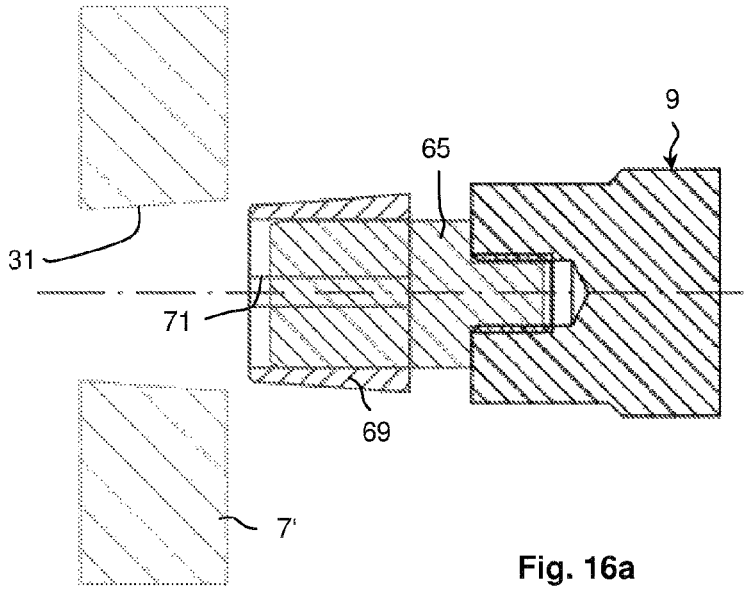
FIG. 16 a schematic illustration of a braking contact or of a separate braking element and of a front end of a switching member with an annular, conical braking element in a position before the engagement of the switching member in an aperture of the braking contact or of the separate braking element (FIG. 16*a*), and in an end position of the switching member.
Figure 16B:
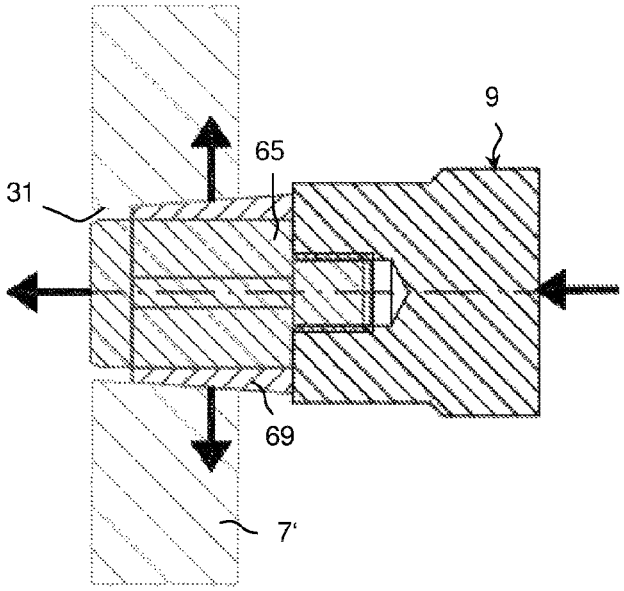

FIG. 16 shows the front end of a switching member 9 on which a cylindrical element 65 is arranged. As illustrated in FIG. 16, the element 65 can be screwed by a threaded section into a corresponding threaded borehole in the front of the switching member 9. Obviously, the cylindrical element 65 and the switching member 9 can also be configured as a single piece. The cylindrical element 65 has an outer diameter that is smaller than the outer diameter of the adjacent area of the switching member 9. This gives rise to a stop shoulder 67.

An annular conical part 69 is pushed onto the cylindrical element 65. To this end, the conical part has an inner diameter that essentially corresponds to the outer diameter of the cylindrical element 65. The conical part 69 can also have one or a plurality of axially extending longitudinal slots or longitudinal grooves. The conical outer wall of the conical part 69 is chosen such that, when the switching member 9 is inserted into the aperture 31 of the contact 3, this wall is impinged on by the inner wall of the aperture 31, which likewise has a conical sectional configuration, such that forces directed radially inward act on the conical part 69. This initially gives rise to friction between the inner wall of the aperture 31 of the contact 3 and the outer wall of the conical part 69 as well as between the inner wall of the conical part 69 and the outer wall of the cylindrical element 65. As a result of the strong force with which the switching member 9 is pushed in, this leads to a temperature increase and to material flows, which here again can be received by the longitudinal slots or the longitudinal grooves in the outer wall of the conical part 69. The stop shoulder stops the sliding movement of the conical part 69 on the element 65 so that upon reaching the stop, the conical part 69 together with the rest of the switching member 9 is pressed into the aperture 31.

The longitudinal slots in the conical part 69 can be configured as evenly distributed over the periphery. However, as shown in FIG. 16 it is also possible to provide just one continuous axial longitudinal slot 71. In addition it is possible to provide any other structurings in the outer periphery of the conical part 69 and/or in the inner periphery of the aperture 31 that are capable of receiving flowing material. Reference can be made to the embodiments of FIGS. 14 and 15 as regards the functionality thereof.

Lastly, it should be mentioned that features that are explained only in combination with one or more of the embodiments described in the preceding can obviously also be combined with other embodiments. This applies in particular to the design of the stop area of the switching member 9, which can be configured as a mere cone or which can comprise a stop flange 41. Obviously other combinations hereof are also conceivable. The structurings for enabling material flows described in conjunction with FIGS. 14, 15, and 16 and the fusion of the switching member with the respective contact made possible thereby can obviously be provided in all variants. This structuring and/or fusion of the switching member with a contact would also be achievable irrespectively of a possible free movement phase of the switching member 9.

This also applies to the different variants of contact units, switching members, and switching functions described in the figures. If such long switching paths are not required, the drive can then be permanently (i.e., during the entire movement between the initial position and the end position of the switching member) coupled to the switching member. The advantages of the contact units and contacting variants described in the preceding, in particular the flexible design of switching functions by the provision of a bar-shaped switching member that engages in apertures in the contacts or in the braking element, are retained.

Other, not illustrated variants shall briefly be described in the following.

In one variant, the switching member illustrated in the drawings, which as a rule has a circular cross section, can have another, for example a rectangular, in particular a flat rectangular cross section. The apertures in the contacts then have a correspondingly complementary shape. This gives rise to the advantage that the switch can be designed as a flat assembly.

It is also possible to use a plurality of switches, wherein at least two contacts interact with at least two switching members. It is thus possible to create a redundancy on one hand, and to connect or disconnect different contacts, for example, to or from the same contact on the other hand.

The housing of the switch, which as described above surrounds certain components or all components of the switch, can also be used and be accordingly configured in such a way that the state of the switch can be determined from the outside. At the same time the material of the housing or of one or a plurality of coatings on the inside or outside can be chosen so as to give rise to an electromagnetic screening effect.

The switch state can be rendered visible by, for example, the housing being made, at least in relevant areas, out of a material or coated with a material such that a power loss, which occurs in the switch in certain switching states, or electromagnetic fields, which are generated in certain switching states, will lead to a change in the state of the material of the housing or of the housing coating. In particular, use can be made of materials that react to the presence of electromagnetic fields or temperature changes brought about by the power loss by changing color. In this manner, the switch state can be established and/or monitored visually, even from further away.

In general, the housing can be produced from any material, provided that the specific electrical conductivity thereof is low in relation to the specific electrical conductivity of the materials in the current path. For example, use can also be made of graphite as a housing material so that the housing or rather the entire switch can be used for high temperature applications.

LIST OF REFERENCE SIGNS

1 electric switch
3 contact
4 contact unit
5 contact unit
7 braking element, 7' braking contact
9 switching member

9*a* contact part
9*b* insulator part
11 drive
13 coupling elements
15 drive element
17 axial coupling pins
19 housing
21 holding means
23 housing part
25 triggering device
27 receiving space
29 sealing edge
31 aperture
33 sensor
35 momentum transfer element
37 recess
39 coil
41 stop flange
43 contact means
45 plunger coil
47 actuator element
49 lever
51 helical spring
53 pressure plate
55 triggering device
57 sealed housing
59 membrane
61 breakout area
63 thin spot
65 cylindrical element
67 stop shoulder
69 conical part
71 longitudinal slot
73' groove
73" groove
75' projection
75" projection
77 groove
79 projection

The invention claimed is:

1. An electric switch with a contact unit comprising at least two contacts, a switching member, and a drive for the switching member, wherein the drive is configured such that it moves the switching member from an initial position into an end position, the switching member is indirectly or directly accelerated by the drive during an acceleration phase and then passes through a free movement phase until it reaches the end position, the drive is coupled to the switching member until the free movement phase is reached, and a moving drive element of the drive is connected to the switching member in such a way that during a stop phase following the acceleration phase, the switching member separates from the drive element and then passes through the free movement phase.

2. The switch according to claim 1, wherein the switching member, when viewed in a movement direction, comprises at least a contact part made of an electrically conductive material and at least an insulator part made out of an electrically insulating material.

3. The switch according to claim 2, wherein the contact unit and the switching member are configured such that the switching member, in the end position, is held with the at least one insulator part in a contact of the contact unit in such a way that a required minimum distance between the contact part and the contact is maintained.

4. The switch according to claim 1, wherein the switching member, in the initial position and in the end position, extends through one or a plurality of contacts in an aperture, wherein for establishing an electrical contact, a plurality of elastically configured contact elements are distributed over an inner periphery on an inner wall of each aperture, wherein the contacts impinge upon an outer periphery of the switching member.

5. The switch according to claim 1, wherein the switching member is generally round/concentric and wholly or partially becomes a flat assembly, wherein at least the contacts are correspondingly likewise designed for the flat assembly.

6. The switch according to claim 1, wherein at least the switching member and the contacts are coaxially configured as a unit.

7. The switch according to claim 1, wherein a housing in which the switching member and the contacts are located is made entirely out of well-insulating materials.

8. The switch according to claim 1, wherein a housing in which the switching member and the contacts are located is made entirely or partially out of only poorly electrically insulating materials.

9. The switch according to claim 1, wherein a housing in which the switching member and the contacts are located is constructed such that it is well-insulated electrically on the inside, but has on the outside at least one layer that is a good electrical conductor in order to create a potential reference and thus weaken or prevent electromagnetic interferences during and after the triggering of the switch.

10. The switch according to claim 1, wherein a housing in which the switching member and the contacts are located is coated or surrounded on the inside or outside with a solid, gelatinous, or liquid layer in order to be able to exploit dielectric or light or temperature properties of this layer.

11. An electric switch with a contact unit comprising at least two contacts, a switching member, and a drive for the switching member, wherein the drive is configured such that it moves the switching member from an initial position into an end position, the switching member is indirectly or directly accelerated by the drive during an acceleration phase and then passes through a free movement phase until it reaches the end position, and the drive has a momentum transfer element, which when a switching process is triggered, accelerates in the direction of the switching member and is then uncoupled from the drive such that the momentum transfer element passes through a free flight phase with a prespecified momentum and transfers at least a portion of the momentum to the switching member such that the switching member is moved from the initial position into the end position.

12. The switch according to claim 11, wherein after its free flight phase, the momentum transfer element impacts the switching member, wherein the momentum transfer element and the switching member are designed in such a way that the momentum transfer element, upon impacting the switching member, is joined to the switching member and is moved together with the switching member from the initial position into the end position.

13. An electric switch with a contact unit comprising at least two contacts, a switching member, and a drive for the switching member, wherein the drive is configured such that it moves the switching member from an initial position into an end position, the switching member is indirectly or directly accelerated by the drive during an acceleration phase and then passes through a free movement phase until it reaches the end position, and the switching member has a stop area, which when viewed in a movement direction is provided on a front end of the switching member and configured such that the switching member is braked at the end of the free movement phase until reaching the end position, wherein the stop area interacts with a separate stationary braking element of the contact unit or with a braking contact of the contact unit configured as a braking element.

14. The switch according to claim 13, wherein the stop area interacts with an aperture provided in the braking element or in the braking contact, wherein the aperture is provided coaxially in the braking element or in the braking contact with respect to the movement direction and to a longitudinal axis of the switching member, wherein the stop area engages in the aperture, at least during a stop phase until the end position is reached.

15. The switch according to claim 14, wherein the stop area has a radial stop flange or one or a plurality of stop projections extending radially outward, which interact with a wall surrounding the aperture in the braking element or in the braking contact for limiting an axial movement of the switching member in the free movement phase.

16. The switch according to claim 14, wherein the stop area has an area that tapers conically towards the front end of the switching member, wherein the stop area interacts with an inner wall of the aperture in the braking element or in the braking contact for braking an axial movement of the switching member in the free movement phase, wherein the inner wall of the aperture is also configured as tapering conically with respect to the longitudinal axis and the movement direction of the switching member, wherein a cone angle of the inner wall of the aperture is equal to or greater than the cone angle of the tapering area of the switching member.

17. The switch according to claim 14, wherein the stop area has in its periphery and/or the aperture has in its inner wall a structuring configured such that the stop area engaging in the aperture during the switching movement of the switching member gives rise to a material flow that leads to the fusion of the stop area with the braking element or with the braking contact.

18. The switch according to claim 17, wherein the stop area has axially running grooves or axially running and radially outward-extending projections, wherein outer surfaces of the radially outward-extending projections are located on an imaginary cone that tapers toward the front end of the switching member and/or the inner wall of the aperture has axially running grooves or axially running and radially inward-extending projections, wherein inner surfaces of the radially inward-extending projections are located on an imaginary cone that tapers in the movement direction of the switching member.

19. The switch according to claim 14, wherein the stop area, comprises an axially displaceable, slotted ring, which is configured and which interacts with the aperture in the braking element or braking contact such that during the stop phase, with progressive axial movement of the switching member an increasing radial contact pressure arises between an inner wall of the aperture and the outer wall of the switching member in the stop area, thereby generating an axial braking effect until the end position is reached.

20. The switch according to claim 14, wherein the stop area of the switching member and the aperture of the braking element or of the braking contact are configured and adapted to a kinetic energy of the switching member to be braked such that at least a partial area of the stop area fuses with the braking element or with the braking contact during the braking of the switching member.

* * * * *